US005095678A

United States Patent [19]

Murphy

[11] Patent Number: 5,095,678

[45] Date of Patent: Mar. 17, 1992

[54] STRUCTURAL STUD

[75] Inventor: Wesley T. Murphy, Auburn, N.Y.

[73] Assignee: Steelway Housing, Skaneateles, N.Y.

[21] Appl. No.: 644,499

[22] Filed: Jan. 23, 1991

[51] Int. Cl.[5] ..... E04C 3/30

[52] U.S. Cl. ..... 52/731; 52/732; 52/588

[58] Field of Search ..... 52/731, 732, 284, 588

[56] References Cited

U.S. PATENT DOCUMENTS

| | | | |
|---|---|---|---|
| 1,541,571 | 6/1925 | Hughes | 52/731 |
| 3,526,074 | 9/1970 | Miller | 52/731 |
| 3,562,992 | 2/1971 | Kinsey | 52/731 |
| 3,611,666 | 10/1971 | Poyser et al. | 52/731 |
| 3,950,912 | 4/1976 | Lundberg et al. | 52/731 |
| 4,192,119 | 3/1980 | Murphy . | |
| 4,201,026 | 5/1980 | Murphy | 52/731 |
| 4,461,134 | 7/1984 | Lowe | 52/732 |
| 4,760,682 | 8/1988 | King | 52/731 |

*Primary Examiner*—Gary L. Smith
*Assistant Examiner*—Michael J. Milano
*Attorney, Agent, or Firm*—Wall and Roehrig

[57] ABSTRACT

A structural beam having at least one open-faced end flange that can be snap-fitted into the end of a similar stud to create a high strength structural assembly. The interlocking flanges are equipped with locking devices that prevent the studs from separating in assembly. Each flange is also equipped with a flexible distal wall with an outwardly turned lip which is adapted to apply a biasing holding force on the interlocked flanges. The lip also serves as a useful mechanism for engaging structural panels mounted upon the assembly.

7 Claims, 4 Drawing Sheets

STRUCTURAL STUD

BACKGROUND OF THE INVENTION

This invention relates to a roll-formed structural stud and, in particular, to a structural stud having a ball flange that is capable of being interlocked with a second box flange carried by a stud of similar construction.

As is well known in the art, preformed structural shapes have been used for some time in the building industry to carry out a wide variety of tasks. For the most part, however, these preformed members are generally designed for a specific application, are usually complex in construction, are relatively difficult to assemble, and require special tools to erect. Furthermore, once brought into assembly, the component parts of the unit usually do not provide sufficient temporary strength during the erection process to allow the assemblage to be quickly and safely completed.

U.S. Pat. No. 4,192,119 shows a structural member having rectangular-shaped end flanges capable of being interlocked to form right angle sections or rectangular columns. While this double D-type member is a significant improvement in the art, it does not provide the versatility which is desired in certain building applications. When used with soft paneled materials such as sheet rock or cement board there is relatively little resistance to racking forces, and additional measures must be taken to achieve the desired stability. As weaker sheeting materials are becoming more common, the racking problem has become more prevalent in the art. More importantly, the D-shaped flanges exhibit a low holding power when locked together and the inside flange can slide laterally towards the opening of the outer or receiving flange thus causing serious problems during and even after the assembly is completed.

SUMMARY OF THE INVENTION

It is therefore a primary object of the present invention to improve structural members used in the construction of buildings and the like.

Another object of the present invention is to provide an improved structural member that is capable of being joined to similar members, without the aid of special tools, to provide right angle sections or rectangular columns.

A further object of the present invention is to simplify the form of interlocking structural members used to create building sections.

Yet another object of the present invention is to provide an improved flanged structural member that can be simply snapped into place with another similar structure to provide an assembly having extremely high holding power to allow the assemblage to be rapidly and safely erected and not come apart once assembled.

A still further object of the present invention is to provide an improved structural member which can be used in building columns, wall plates and other various and diversified applications.

Still another object of the present invention is to provide an improved structural member which resists racking forces when employed together with soft panels.

Yet another object of the present invention is to provide a sheet metal stud having interlocking open-ended flanges that are configured so that the flanges cannot slide laterally through the flange openings when placed in an interlocked condition.

These and other objects of the present invention are attained by means of interlocking structural studs, each of which has an open-ended box flange in at least one of its extremities. The flanges are arranged so that one is rotatably receivable within another. The flanges have coacting crimped walls that snap together in assembly to lock the studs in a desired condition. Each flange further includes a short lip on the distal end wall of the flange that extends outwardly from the web of the stud. When two flanges are interlocked, the lip of the inner flange is forced into biasing contact with an opposing wall of the receiving flange to further secure the interlocked studs in assembly. The lip of the outer or receiving flange protrudes slightly beyond the periphery of the interlocked stud assembly and is thus capable of being anchored in an exterior panel mounted on the assembly to resist movement of the panel.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1:
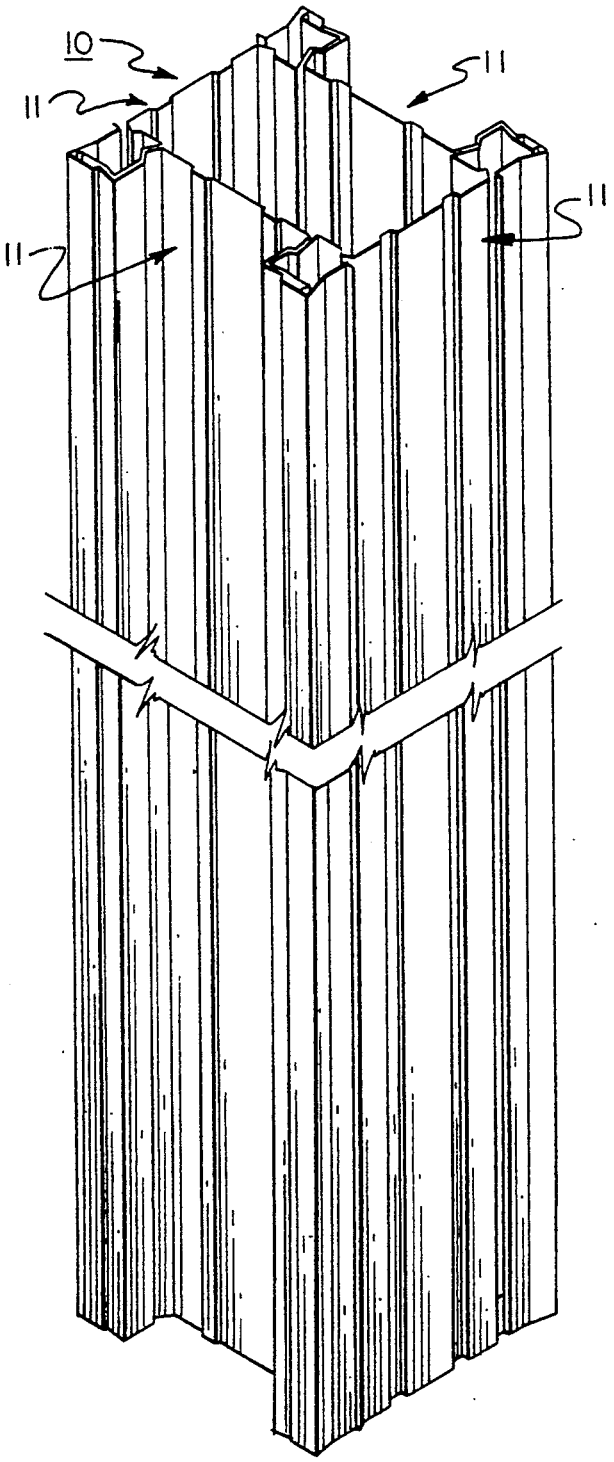
FIG. 1 is a fragmentary perspective view of a column assembled from structural studs in accordance with the present invention.
Figure 2:
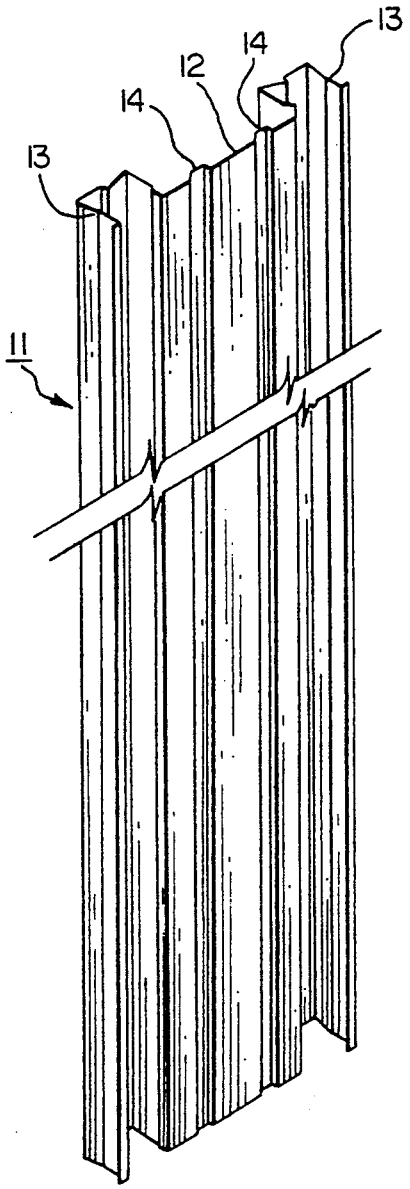
FIG. 2 is a fragmentary perspective view of a roll-formed structural stud embodying the teachings of the present invention.
Figure 3:
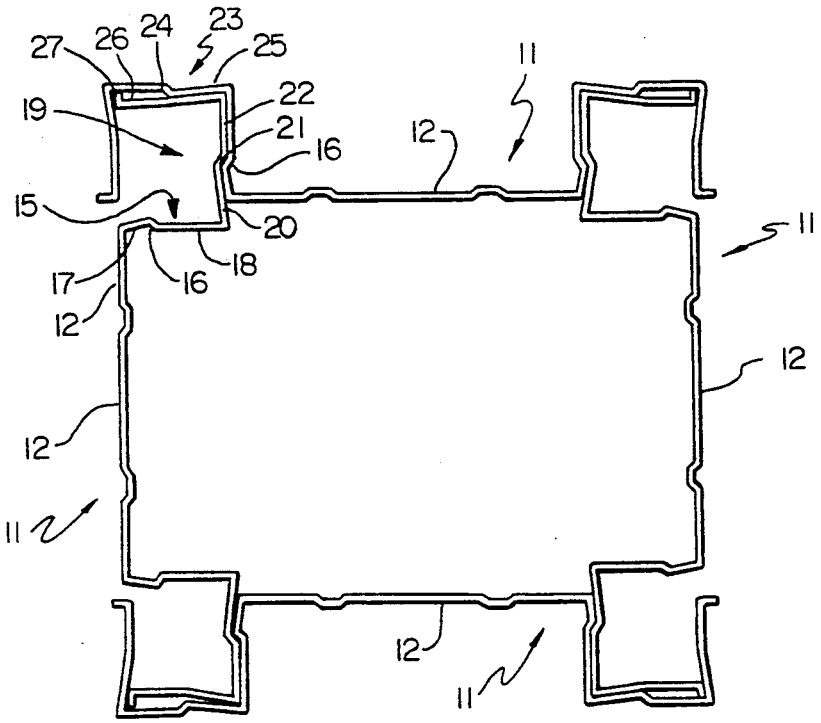
FIG. 3 is a top plan view of the column shown in FIG. 1.

As illustrated in FIG. 1, there is shown a building column generally referenced 10 that is formed by bringing together four structural studs, generally designated 11, which embody the teachings of the present invention. As further illustrated in FIGS. 2 and 9, each of the four studs are roll-formed structures containing a planar web 12 and a pair of opposed, open-faced, box-shaped end flanges 13—13 that extend along the side edges of the web. Preferably, each stud is roll-formed from a single sheet of material, preferably metal, so that the stud has relatively high strength but is yet resilient enough to permit the end flanges to resiliently deform under pressure so that a flange carried by one stud can be snap-locked into a flange carried by a second stud to securely lock the studs together in assembly. The web of each stud is furnished with one or more corrugations 14—14 extending along the length of the web for increasing the stud strength of the member so that it will not buckle or bend during the erection process or after assembly.

Figure 9:
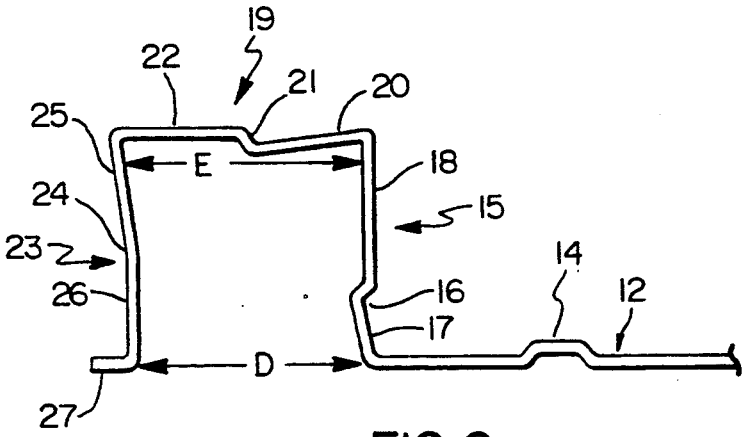
FIG. 9 is an elevation of an end flange of a structural stud in accordance with the present invention further showing the flange construction.

As best illustrated in FIG. 9, each flange is generally box-shaped in cross-section and has three co-joined orthogonally positioned walls designated 15, 19 and 23. Sidewall 15 depends from one outer extremity of the web 12 and is herein referred to as the proximal wall. The proximal wall 15 is joined to distal wall 23 by top wall 19 to complete the open-faced box.

The proximal wall further contains two segments 17 and 18 that are offset one from the other by a sharp crimp 16 that runs the length of the flange. The first shorter segment 17 is angulated obtusely with regard to the web 12 while the longer second segment 18 is perpendicular with the plane of the web. The plane of segment 18 intersects the plane of the web at the corner established by the web and the shorter segment 17.

The top wall 19 also contains two segments 20 and 22 that are offset by a second sharp crimp 21 that runs the length of the flange and complements the first crimp 16. The segment 20 forms an acute interior angle with segment 18 of the proximal wall. The second segment of the top wall is parallel to the plane of the web and perpendicualr to the segment 18. The planes of segments 18 and 22 intersect at the flange corner formed between the proximal side wall and the top wall. The length of segment 22 is about equal to that of segment 18, the reason for which will be explained in greater detail below.

The distal side wall 23 of the flange also contains two segments 25 and 26 that form a bend line 24 extending along the length of the flange. Segment 25 forms an acute interior angle with segment 22 of the top wall while the second segment 26 is generally perpendicular to the plane of the web. The terminal end of the segment 26 is bent outwardly away from the web at about 90° to form a lip 27 lying in the plane of the web. The length of the lip is such that it extends outwardly beyond the corner formed between the distal wall and the top wall. As will be explained below, the lip is designed to carry out a plurality of important functions that improve the security of interlocked assembly.

The width of the flange opening D (FIG. 9) is less than interior length E of the top wall due to the construction of the distal wall.

Figure 7:
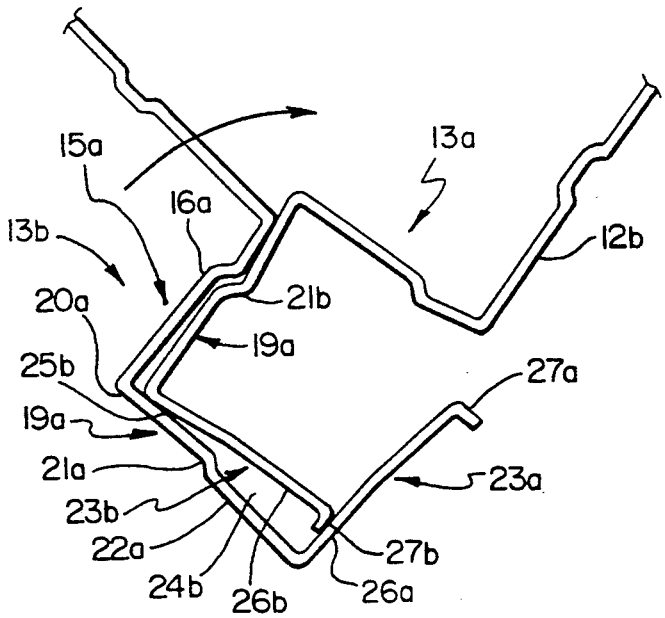
FIG. 7 illustrates two end flanges embodying the teachings of the present invention mounted one inside the other in an unlocked condition.

To interlock two studs together to form a desired structure such as column 10 in FIG. 1, the end flange 13*a* of a first stud is obliquely inserted into the end flange 13*b* of a second stud as shown in FIG. 7 so that the distal wall 23*a* of the inner flange faces the top wall of the outer flange. When in this position, the top wall 19*b* of the inner flange faces the proximal wall 15*a* of the outer flange. To lock the flanges the two complementary crimps 16*a* and 21*b* of the flanges are placed in abutting contact and the inside flange is turned clockwise as shown in FIG. 7 to bring the proximal wall of the outer flange into face-to-face contact with the top wall of the inner flange. This rotating action also brings lip 27*b* into abutting contact with the top wall of the outer flange. Because of the extended length of the lip, the entire distal wall of the inner flange is biased inwardly to establish a spring-like locking force acting between the flanges. This, in turn, prevents the top wall of the inner flange from moving over the proximal wall of the outer flange. As should now be evident, the two flanges are now snap-locked together and the inner flange cannot slip or slide within the outer or receiving flange. The only way to disconnect two interlocked studs is to rotate the inner flange in a counterclockwise direction with regard to the outer flange thereby releasing the biasing force on the distal arm of the inner flange and separating the two complementary crimps.

Figure 8:
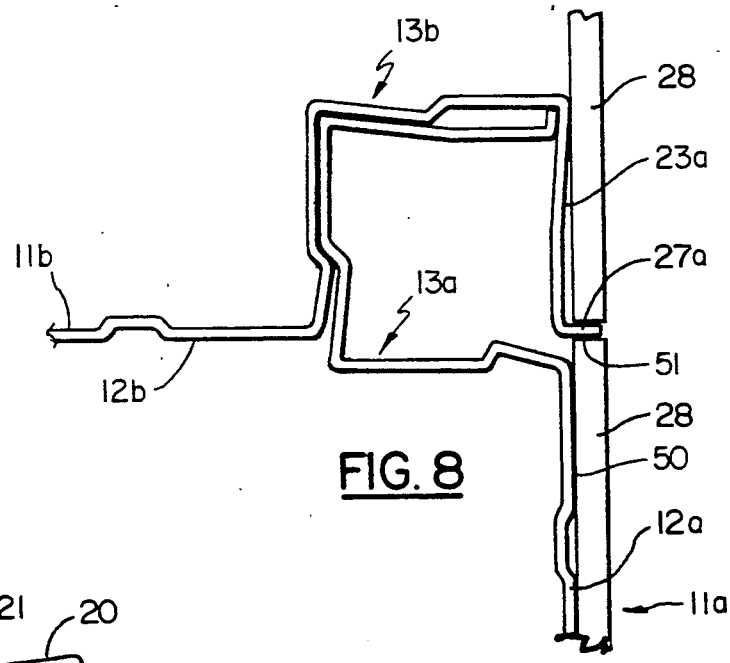
FIG. 8 shows the use of a stud assembly in accordance with the present invention as a wall plate.

As illustrated in FIG. 8, the lip 27*a* of the inner assembled flange 13*a* extends outwardly beyond the bottom surface 50 of the companion web 12*a*. In an application where wall panels 28—28 are to be mounted against the bottom surface of the web 12*a*, the lip 27*a* may be situated so that it resides within the seam 51 between two panels. The insertion of the structurally supported lip provides an anti-racking resistance to the panels when they are placed under load. This additional strength is extremely important where the panels are fabricated from sheet rock or cement board which are comparatively weak when compared to wooden panels.

In the event the lip 27*a* cannot be placed within a seam, the distal wall 23*a* of the stud will be urged inwardly when the panel is affixed in contact against the bottom surface 50 of the web 12*a* of stud 11*a*. The distal wall thus places a contact biasing force against the back of the panel which strengthens the overall assembly. Additionally, an air space is created between the panel and the distal wall. This can be especially useful when the panelling terminates near the edge of the interlocked flanges as for example where the assembled studs are used as a wall plate. Caulking or other types of weatherizing material may be placed within the air gap between the distal arm and the wall panel.

Figure 4:
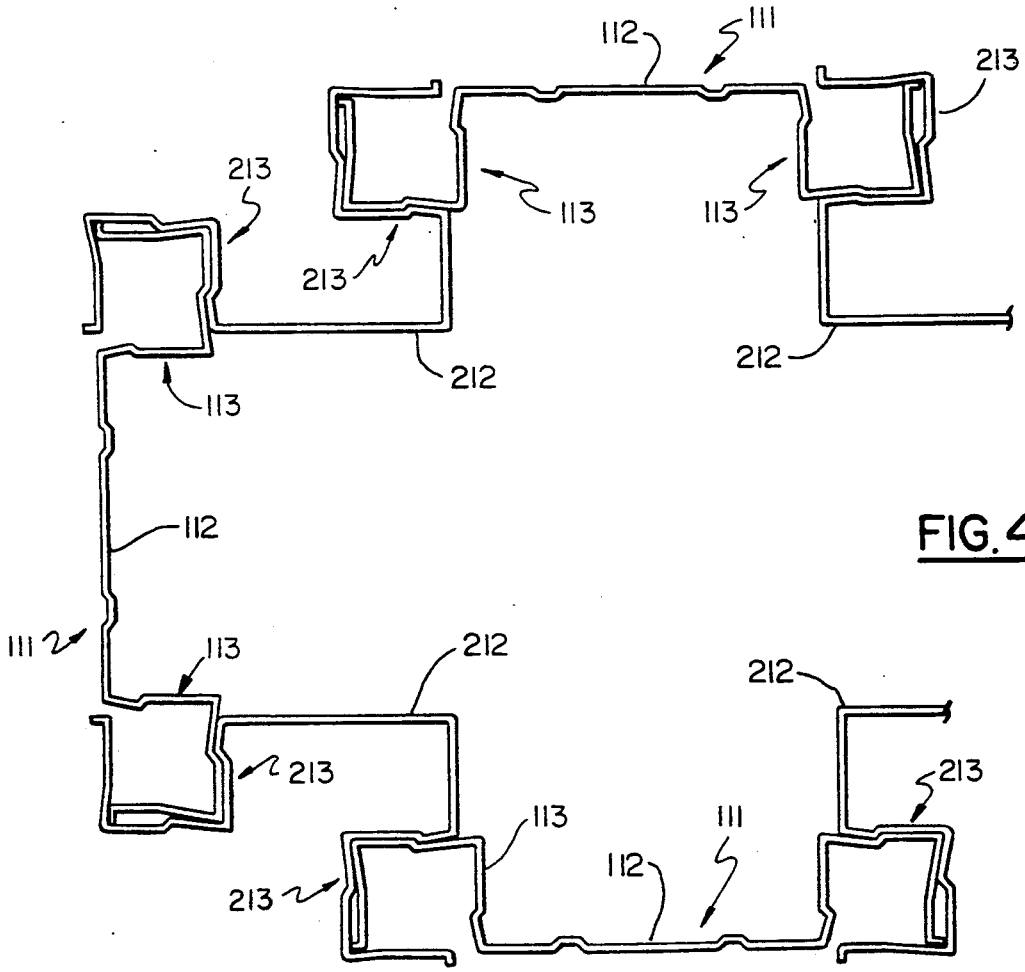
FIG. 4 is a top plan view of a column assembly comprising multiple studs in accordance with alternate embodiments of the invention.
Figure 5:
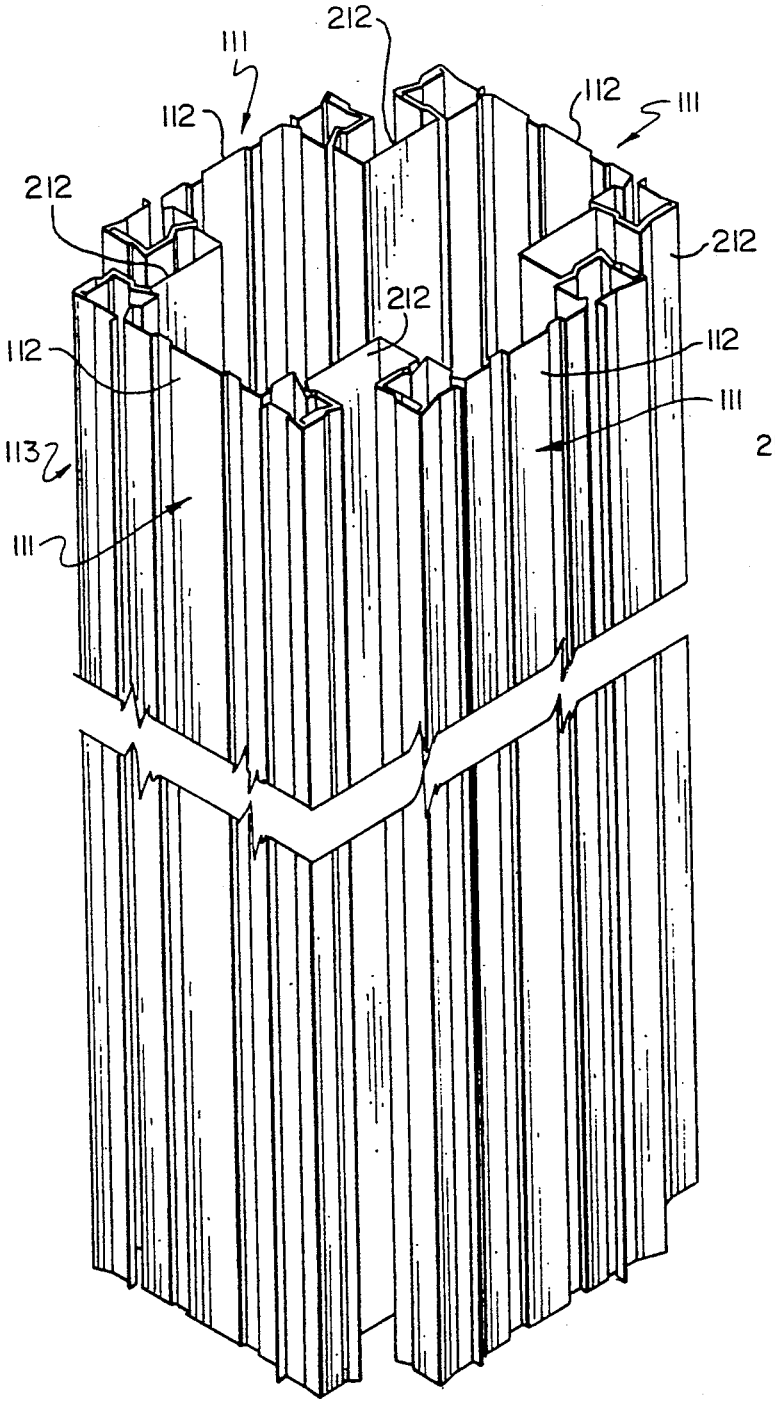
FIG. 5 is a fragmentary perspective view of the assembly shown in FIG. 4.
Figure 6:
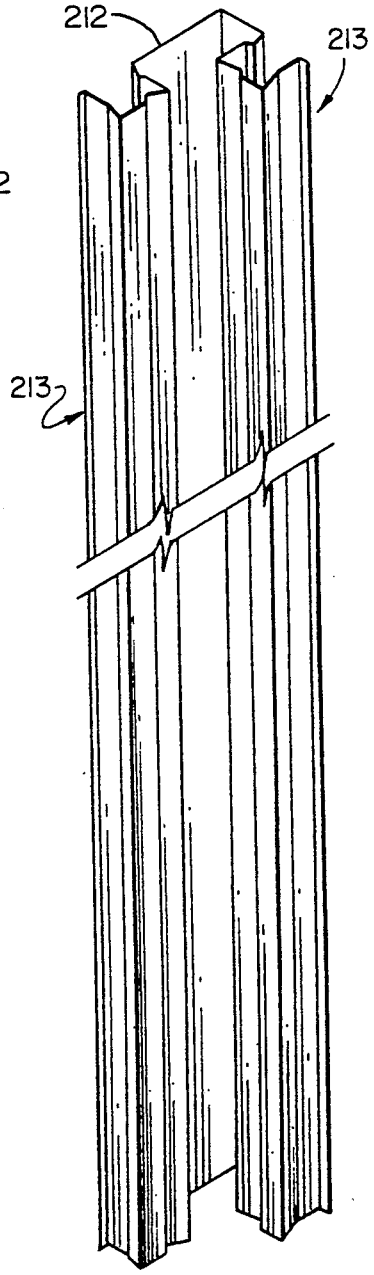
FIG. 6 is a fragmentary perspective view of a structural stud showing an alternate embodiment of the present invention.

FIGS. 4–6 show an alternate embodiment of the invention wherein flanges as described above are mounted on webs having dissimilar configurations to create different structural studs. In this particular embodiment, stud 111 is of the same construction as stud 11 shown in FIG. 2 and has a straight web supporting two flanges 113—113 at the outer extremities thereof. The remaining studs 211—211 contain webs 212 that are bent 90° at 213 to provide right angle corner pieces. Flange 213, as described above, is mounted at the extremities of the bent webs and is arranged to interlock with the flanges of studs 111—111 as shown.

While this invention has been described in the specification and illustrated in the drawings with reference to a preferred embodiment, it will be understood by those skilled in the art that various changes may be made and equivalents substituted for elements of the invention without departing from the scope of the appended claims.

What is claimed is:

1. A structural stud including an elongated web having top and bottom sides and at least one flange extending from the extremity thereof which is adapted to interlock with a flange of similar construction in a second structural stud, each flange comprising a proximal side wall having a first segment obtusely angulated with the web, and a second segment normal to the plane of the web and being offset from said first segment by a first crimp, a top wall having a third segment angulated acutely with said proximal side wall, and a fourth segment parallel to the plane of the web and being offset from said third segment by a second crimp, the third segment being about as long as said first segment, a distal side wall having a fifth segment angulated acutely with said top wall, and a sixth segment normal to the plane of the web, a terminal lip connected to the sixth segment lying in the plane of the web and directed outwardly away from said web, an opening extending from the connection of the terminal lip and said sixth segment to the web that is shorter than the inside dimension of the top wall so that when a first inner flange is interlocked within a second outer flange with the distal wall and top wall of said first inner flange facing the top wall and proximal wall respectively of the second outer flange, the second crimp of the first inner flange is locked inside the first crimp of the second outer flange and the terminal lip of the first inner flange is biased securely against the fourth segment of the second outer flange to securely hold the flanges in said interlocked condition.

2. The stud of claim 1 wherein the web has separate flanges mounted along opposed extremities of the web.

3. The stud of claim 2 wherein the web has at least one corrugation rung along its length to provide stiffness to the web.

4. The stud of claim 1 wherein the third segment is longer than said first segment.

5. The stud of claim 2 wherein the openings of both flanges face the same side of the web.

6. The stud of claim 5 wherein the web further includes a bend along its length to form two legs.

7. The stud of claim 3 wherein the web and flanges are rolled from a single sheet of resilient metal.

* * * * *